United States Patent [19]

Helinski

[11] Patent Number: 4,461,207

[45] Date of Patent: Jul. 24, 1984

[54] ACTUATOR MECHANISM FOR A PRINTER OR THE LIKE USING DUAL MAGNETS

[75] Inventor: Edward F. Helinski, Johnson City, N.Y.

[73] Assignee: International Business Machines Corporation, Armonk, N.Y.

[21] Appl. No.: 462,638

[22] Filed: Jan. 31, 1983

Related U.S. Application Data

[63] Continuation-in-part of Ser. No. 207,503, Nov. 17, 1980, abandoned.

[51] Int. Cl.[3] ..... B41J 9/38

[52] U.S. Cl. ..... 101/93.48; 101/93.04; 335/237; 335/230

[58] Field of Search ..... 101/93.04, 93.05, 93.48; 400/121; 335/229, 230, 234, 235, 236, 237

[56] References Cited

U.S. PATENT DOCUMENTS

| | | | |
|---|---|---|---|
| 3,656,425 | 4/1972 | Albo et al. | 101/93.04 |
| 3,659,238 | 4/1972 | Grilfing | 101/93.48 |
| 3,775,715 | 11/1973 | Bosch et al. | 335/230 |
| 3,798,581 | 3/1974 | Anderson et al. | 335/234 |
| 3,906,854 | 9/1975 | Gomi | 101/93.34 |
| 3,941,052 | 3/1976 | Dalziel | 101/93.48 |
| 4,044,668 | 8/1977 | Barrus et al. | 101/93.04 |
| 4,165,940 | 8/1979 | Cacciola | 101/93.05 |
| 4,189,997 | 2/1980 | Nozaki et al. | 101/93.09 |
| 4,200,043 | 4/1980 | Nozaki et al. | 101/93.29 |
| 4,224,589 | 9/1980 | Tamulis | 335/229 |
| 4,233,894 | 11/1980 | Barrus et al. | 101/93.04 |
| 4,258,623 | 3/1981 | Barrus et al. | 101/93.48 |
| 4,392,423 | 7/1983 | Nakajima et al. | 101/93.48 |

OTHER PUBLICATIONS

"Actuators for Bar and Helix Printer"; Meier, Johann; *IBM Technical Disclosure Bulletin*, vol. 21, No. 12, pp. 4813–4816; May 1979.

*Primary Examiner*—Edgar S. Burr
*Assistant Examiner*—David A. Wiecking
*Attorney, Agent, or Firm*—John S. Gasper

[57] ABSTRACT

An actuator element having a fixed end and a magnetizable deflection end is releasably held in spring loaded condition at a non-operative position by an electromagnetic operator. In the preferred form, the actuator element is an elastic beam of magnetically permeable material. The operator comprises first and second permanent magnets for generating separate magnetic fields of the same polarity proximate the magnetizable deflection end of the actuator element and a magnetic core combined with the permanent magnets to form at least first and second magnetic holding circuits with the deflection end of the actuator element through a common return path. A winding on the return path of the core when energized generates flux in opposition to the flux from the permanent magnets to release the actuator element for movement to an operative position. Upon de-energization of the winding, the deflection end of the actuator element is retracted and held by the permanent magnets in spring loaded condition.

19 Claims, 9 Drawing Figures

ACTUATOR MECHANISM FOR A PRINTER OR THE LIKE USING DUAL MAGNETS this invention is a continuation-in-part application of U.S. application Ser. No. 207,503 filed Nov. 17, 1980, now abandoned.

DESCRIPTION

Technical Field

This invention relates to actuator mechanisms and particularly to electromagnetic print hammers of the stored energy type also referred to as no-work print hammers. This invention has utility in related application of W. D. Thorne titled "Band and Hammer Dot Matrix Printer", Ser. No. 135, 803, filed Mar. 31, 1980.

In the operation of electromagnetically operated print hammers, it is important that the hammer element, such as a leaf spring, be capable of repeatedly moving from the stored energy position to the impact position and return in a very short cycle time if printing is to occur at relatively high speeds. It is also important that the hammer settle out rapidly after retraction to the stored energy position before being released to print again. It is also important that the electromagnetic operating structure which retracts, holds and releases the spring loaded hammer element be highly efficient and simple in structure so that power utilization is minimal and manufacturing costs are kept at a minimum without sacrificing performance and reliability. It is also desirable that the electromagnetic structure be adaptable for multiple hammer assembly in which the hammer elements are independently adjustable to compensate for individual hammer flight time variations.

In U.S. Pat. No. 4,189,997 issued Feb. 26, 1980 a permanent magnet is embedded in a non-magnetic hammer head carried on the end of flexure springs. The hammer head is held in spring loaded condition by the magnetic interaction of the permanent magnet with a stationary electromagnet whose winding is energized to release the hammer head for printing. The embedding of the permanent magnet in the hammer head makes the mass of the hammer excessive for many applications. Also the embedding of the permanent magnet in the hammer head subjects the magnet to shock forces both on impact and upon retraction which, unless measures are taken, ultimately affect the operation of the print hammer.

In U.S. Pat. No. 4,200,043 an electromagnet is embedded in the hammer head. The hammer head is held in spring loaded condition by a pair of permanent magnets of opposite polarity. The electromagnet winding is energized through conductive flexure wires supporting the hammer to counteract the flux from the permanent magnets. The electromagnet in the hammer head makes the hammer mass excessive.

In U.S. Pat. Nos. 3,659,238, 3,656,425 and 3,941,052 magnetic armatures are carried on the end of a flexure element. A permanent magnet is connected in a magnetic holding circuit with pole pieces configured to extend proximate the armature. A winding on a pole piece when energized bucks out flux from the permanent magnet to release the armature. U.S. Pat. No. 3,659,238 has a flux path for shunting buck out flux to prevent reverse magnetization of the permanent magnet.

U.S. Pat. No. 4,044,668 discloses a multiple hammer assembly having a magnetic circuit structure including an elongate permanent bar magnet magnetically coupled through a magnetic insert through the fixed end of resilient magnetic hammer elements. A magnetic plate is coupled to the permanent magnet to provide a common return path for individual coil wound pole pieces acting on the deflection end of the hammer elements. The magnetic circuit structure uses dummy end positions beyond the last hammer position to compensate for decreased field strength of the permanent magnet. A front plate of a hammer housing is made of magnetic material to form a parallel flux path with the hammer element to increase the flux density in the deflection end of the hammer elements to the pole pieces. The arrangement uses a single permanent magnet coupled to the hammer element at its remote end. The permanent magnet must be large and the hammer element must be massive to overcome the high reluctance of the long magnetic circuit and to compensate for the excessive flux leakage.

U.S. Pat. No. 3,906,854 shows a control mechanism for plural spring loaded hammers which includes individual magnetic circuits in combination with a flux producing element. Each magnetic circuit includes a hammer hold portion and a control portion connected in parallel and each having a permanent magnet. A control coil on the control portion is energized to reverse the polarity of the control magnet to reduce the net amount of flux in the hold portion of the circuit. The coil is reverse energized to restore the control permanent magnet to the initial polarity for holding the hammer element.

U.S. Pat. No. 4,233,894 shows a print hammer mechanism which uses a single permanent magnet coupled to the fixed end of a flexible hammer element. The structure requires a large permanent magnet to provide magnetic flux conveyed by the two magnetic plates from the fixed end to the remote end of the hammer element. While the arrangement has provided an improvement in the force/displacement characteristics of U.S. Pat. No. 4,044,668 the print hammer circuit still lacks sufficient magnetic efficiency to produce a force displacement which operates at the level exceeding one and a half pounds magnetic retraction force for a displacement in excess of 16 mils at a repetition rate around one millisecond.

SUMMARY OF THE INVENTION

According to this invention, an actuator element having a fixed end and a magnetizable deflection end is releasably held in spring loaded condition at a non-operative position by an electromagnetic operator means. In the preferred form, the actuator element is an elastic beam of magnetically permeable material. The operator means comprises first and second magnetic field producing means for generating separate magnetic fields of the same polarity proximate the magnetizable deflection end of the actuator element and magnetic core means combined with the field producing means to form at least first and second magnetic holding circuits with the deflection end of the actuator element through a common return path. A release means generates flux in the common return path in opposition to the flux from the field producing means.

Preferably the field producing means comprises first and second permanent magnets polarized in the same direction and the core means comprises an E-core structure having inner, outer and center pole pieces extending from a common connection or base of magnetically permeable material. The first and second permanent magnets are supported by the inner and outer pole pieces adjacent the deflection end of the actuator element. The center pole piece has a pole face adjacent the deflection end of the actuator element and acts as the common return path for the flux flowing from the first and second permanent magnets through the magnetizable deflection end of the actuator element. An electric winding on the center pole piece is electrically energized to generate magnetic flux in the center pole piece which counteracts the flux from both the first and second permanent magnets thereby releasing the actuator element for movement in accordance with the deflection energy stored in the actuator element to an actuated or impact position. Flux flows from the first and second permanent magnets which have the same polarity to the deflection end of the actuator and into the center pole piece also located at the deflection end of the actuator element and then through the inner and outer pole pieces. This provides a circuit arrangement of greatly reduced length whereby the reluctance and the flux leakage are greatly reduced and magnetic efficiency is increased. The arrangement provides a magnetic circuit which enables the use of permanent magnets having greatly reduced magnetic volume and actuator elements with reduced cross section to get higher static retraction force, greater deflection, with a high operating frequency. The combination of first and second permanent magnets having the same polarity with a center pole piece providing a common return path all in the vicinity of the deflection end of the actuator element greatly reduces the amount of current required to control the release of the actuator element. The center pole extends beyond first and second permanent magnets forming an air gap. Thus the actuator element is prevented from striking the permanent magnets upon rebound and retraction from the impact position. The extended center pole piece is located so that it engages the actuator element at the second node of vibration to achieve rapid settle out. In another embodiment, the center pole piece is recessed from the surfaces of the permanent magnets and the actuator element carries an armature piece at its deflection end which is positioned between the permanent magnets in the recess. The winding of the center pole piece preferably extends beyond the end of the center pole piece so as to enclose the armature within the winding. The end of the center pole piece in either embodiment may also have a rounded or convex contact surface, preferably spherical and may be covered with a non-magnetic residual material.

In the preferred embodiment, the actuator element is an elastic beam of magnetically permeable material having its fixed end attached to the base member of the core means. The deflection end of the elastic beam has an end portion capable of being magnetized at or near saturation by the holding flux from the permanent magnet on the outer pole piece. A magnetic focusing plate is provided over the permanent magnet on the outer pole piece for concentrating flux from the permanent magnet into the end portion of the elastic beam. The end portion of the elastic beam is preferably tapered to reduce its mass thereby increasing the velocity of the actuator element and insuring operation at or near saturation.

Preferably the end portion of the elastic beam terminates in a rectangular or square tab section of reduced width which extends over the magnetic surface of the permanent magnet on the outer pole piece. The elastic beam supports a raised impactor surface at its deflection end with the tab section extending beyond the impactor surface.

The invention also comprises a hammer mechanism assembly in which the permanent magnets and pole pieces are elongate and have a length coextensive with a plurality of hammer element positions. Individual pole pieces are located at the hammer positions between the first and second pole pieces forming a common flux return path for flux from the first and second permanent magnets to said first and second pole pieces. Individual resilient magnetic hammer elements are coupled to the magnetic structure in each of the hammer positions. Each hammer element has a deflection end disposed for magnetization and normal retraction in spring loaded condition by the permanent magnets. Windings on the individual pole pieces are electrically operable to oppose flux from the permanent magnets in the individual pole pieces to release individual hammer elements. The permanent magnets are preferably strip magnets extending over the surface of the pole pieces over a plurality of print hammer positions. A focusing means comprises a focusing plate of soft iron on the surface of the permanent magnet on the outer pole piece.

In both the single actuator and plural actuator embodiments, means is provided for adjusting the holding force of the operating means. In the preferred form, the adjustment is made by altering the amount of flux in the inner magnetic holding circuit. For that purpose the magnetic shunt associated with the inner permanent magnet and the inner pole piece is provided. The shunt is made adjustable for altering the reluctance of the shunt circuit. One form of adjustable shunt comprises a bolt of magnetically permeable material having a threaded connection with the base member where the bolt has an end disposed to form a shunt air gap with the deflection end of the beam in the vicinity of the inner permanent magnet. An alternate construction provides for a soft iron pole piece on the inner permanent magnet having a surface forming an air gap with the deflection end of the beam. The shunt element of magnetically permeable material is threadedly connected to the magnetic base member and is disposed to form an air gap with the soft iron pole piece. In a further alternative arrangement, the means for adjusting the reluctance is interior to the inner pole piece. For that purpose, a spacer of non-magnetic material is provided between the inner permanent magnet and the inner pole piece. A threaded bolt extends through an opening in the inner pole piece and through the opening in the spacer and is threadedly connected to the inner pole piece so as to be movable to vary the magnetic coupling between the inner permanent magnet and the inner pole piece. In this manner the holding force of the elastic beam can be precisely adjusted to compensate for variations in magnetic strength of the permanent magnets and spring rate variances of the elastic beams. This is particularly advantageous in multiple hammer assemblies where due to tolerance variations the operating characteristics of individual hammers may vary substantially. By adjusting the reluctance of the inner holding circuit, flight time corrections can be made without altering the starting positions of the individual hammers as established by the center pole piece which engages with the deflection end of the hammer elements.

Furthermore, the provision of a focusing plate on the outer magnet assures concentration of flux from the outer permanent magnet into the end of the elastic beam. This assures that each hammer element is operating at or near saturation such that when adjacent hammer elements are released the magnetic holding force on the non-released hammers does not appreciably change.

The foregoing and other objects, features and advantages of the invention will be apparent from the following more particular description of preferred embodiments of the invention, as illustrated in the accompanying drawings.

BEST MODES FOR CARRYING OUT THE INVENTION

Figure 1:
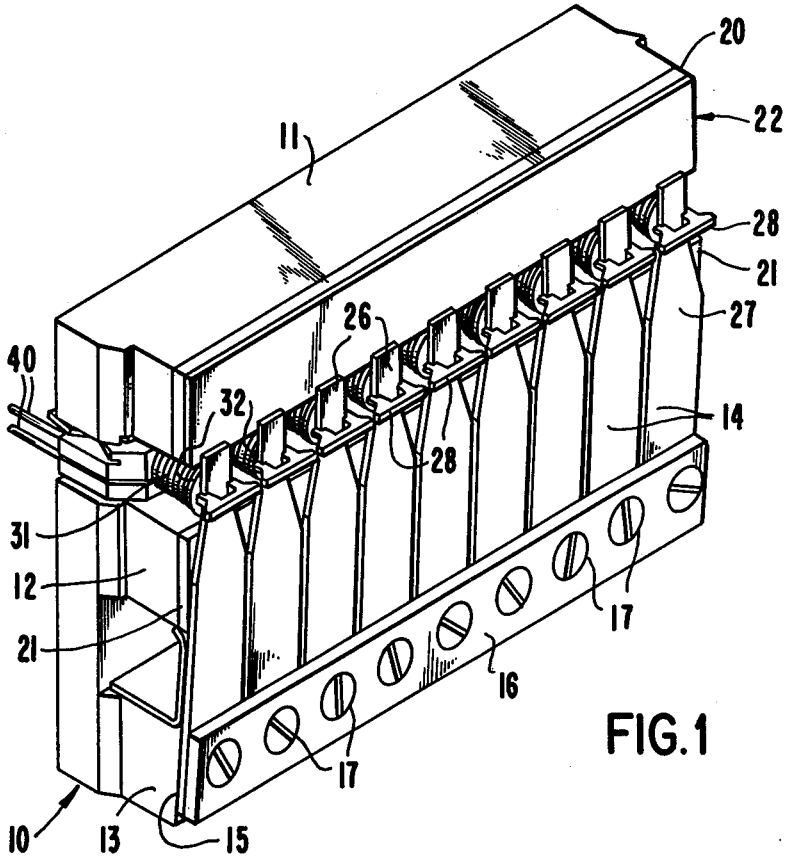
FIG. 1 is a perspective drawing showing a multiple print hammer assembly incorporating the various features of the invention.
Figure 2:
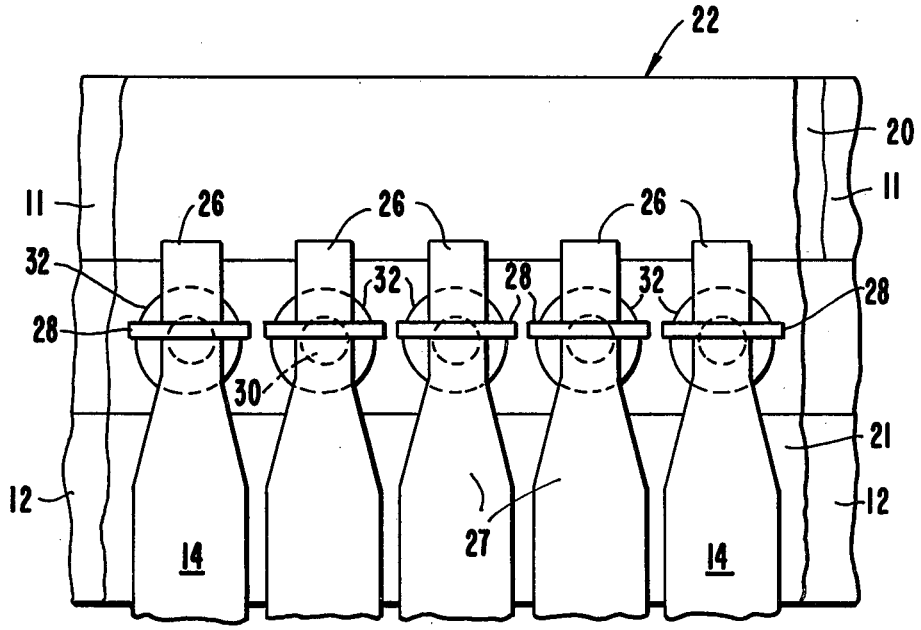
FIG. 2 is a front view of a portion of the hammer assembly structure of FIG. 1.
Figure 3:
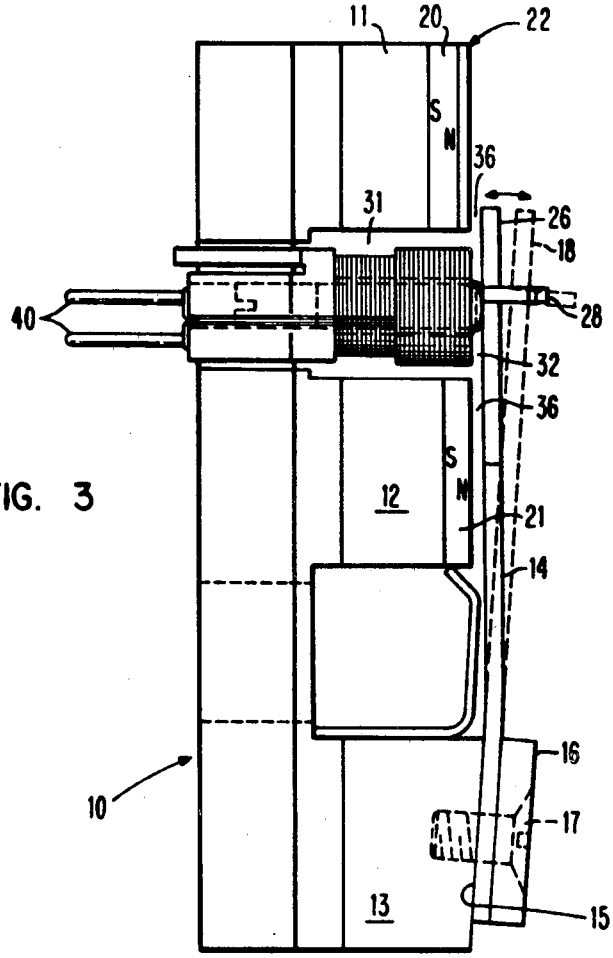
FIG. 3 is a side elevation of the hammer assembly of FIG. 1.

As seen in FIGS. 1 and 3, an embodiment of a multiple hammer unit assembly incorporating the features of the invention includes a core means comprising base member 10 having outer pole piece 11 inner pole piece 12 and a support post 13. Base member 10, pole pieces 11 and 12 and support post 13 may all be fashioned from a single block of magnetically permeable material. Alternatively, the base member 10 pole pieces 11 and 12 and post 13 can be separately fabricated from magnetically permeable material and attached together by bonding or some other suitable means for the arrangement shown. Furthermore, post 13 could also be made of a non-magnetic material. Pole pieces 11 and 12 and post 13 are preferably elongate so as to extend over several print hammer positions. Flexible hammer elements 14 are fixed at one end to surface 15 of post 13 in the manner of elastic cantilever beams at uniformly spaced positions by suitable means such as clamping plate 16 and screws 17. Surface 15 of post 13 is preferably slanted giving hammer elements 14 an outward print or actuated position when in their unflexed condition as illustrated by the broken lines in FIG. 3. In a preferred embodiment, the flexible hammer elements 14 are fabricated as integral fingers of a single plate in which the fingers are formed and shaped in a single fabrication operation.

In accordance with the invention, the hammer elements 14 are normally held in a retracted, spring loaded, non-print position (as shown by the solid lines in FIG. 3) by magnetic forces produced by two permanent magnets 20 and 21 coupled to the faces of poles pieces 11 and 12. The permanent magnets 20 and 21 are elongate strips which cover multiple hammer positions depending on the number of print positions per hammer unit. More than one magnet strip may be applied to each pole piece each covering one or more hammer positions. Suitable material for the strip magnets 20 and 21 can be one of the high energy product magnets such as Samarium Cobalt SmCo5 having a thickness of approximately 0.060 inches. A focusing plate 22 of thin, soft iron, e.g. 0.020 inches or other suitable magnetically permeable material is applied over the outer magnet 20.

Preferably hammer elements 14 are integral fingers fabricated from a single sheet of magnetically permeable material such as 8620 steel having uniform thickness and extending from the fixed end attached to post 13 to the deflection end 18 which extends above strip permanent magnet 20 and the lower edge of strip magnet 21 and 22. At their deflection end, hammer elements 14 have a rectangular tab portion 26 of reduced width extending from a tapered portion 27. Impactor blades 28 of non-magnetic or magnetic but preferably of the same material are attached to tab section 26. The amount of tapering and the dimensions of the tab section 26 as well as other dimensions of hammer element 14 can vary depending on the desired spring rate and magnetic permeability of the hammer elements relative to the magnetic strength of the permanent strip magnets 20 and 21.

Impactor blades 28 can take various forms but preferably are designed for impacting impression forming elements of a type element such as the dot band member described in said co-pending application of W. D. Thorne. For such application the impactor blades 28 may have a horizontal dimension equal to several character spaces. Alternatively other impactor elements may be used on hammer elements 14 in place of the blades 28 for forming dot impressions directly on a print medium (not shown) with the impactor element attached to the hammer element being shaped accordingly, i.e. as a cylindrical protrusion from the tab sections 26.

Also included in the multiple hammer embodiment of the invention are individual center pole pieces 30 of magnetically permeable material each surrounded by an electric coil 31 wound on a bobbin 32. Coils 31 are connectable for energization to an external power source via connector pins 40. Center pole pieces 30 which are located in line with each hammer element position between pole pieces 11 and 12 extend outwardly from base portion 10 to form an E-core structure. The center pole pieces 30 terminate in a pole face 33 covered with a cap 34 of non-magnetic residual material. Center pole pieces 30 are made to extend beyond the respective surfaces of focusing plate 22 and inner permanent magnet 21 so that surface 35 on cap 34 makes contact with tab sections 26 of the hammer elements 14 when in their retracted position so as to maintain an air gap 36 between the focusing plate 22 and tab 26 and also between permanent magnet 21 and hammer element 14. Surface 35 of residual cap 34 is rounded or convex preferably with a spherical contour. The convex or spherical contour is primarily to insure contact over a large radius and to prevent impact of hammer elements 14 on center pole piece edges which would concentrate wear and may cause settle out problems due to the hammer elements 14 striking center pole pieces 30 at locations other than the nodal point of second mode of vibration. The settle out is further enhanced by positioning the center pole pieces 30 so that they engage the back of the hammer elements 14 at or as close as possible to the second node of vibration. Preferably impactor blades 28 are positioned above or beyond the second node position. A threaded connection 37 attaches center pole piece 30 to base member 10 and allows rotation of center pole pieces 30 in a well known manner to adjust the air gaps 36 thereby readily making adjustments in the flight times of the individual hammer elements 14 to compensate for tolerance variations in spring rate characteristics of the hammer elements 14.

Figure 4:
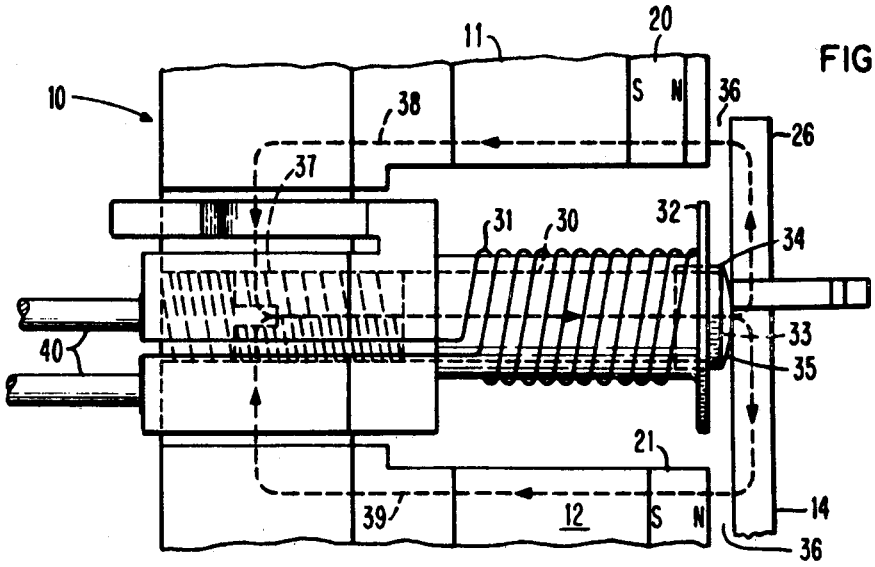
FIG. 4 is an enlarged view of a portion of the hammer assembly of FIG. 3.

In accordance with the invention the permanent magnets 20 and 21 are polarized in the same direction and are supported and magnetically coupled to the E-core structure made up of the base member 10, outer pole piece 11, inner pole piece 12 and the individual center pole pieces 30. As shown more clearly in FIG. 4, the magnetic surface structure of the invention produces dual closed magnet holding circuits for holding each hammer element 14 in spring loaded condition. In the outer magnetic holding circuit magnetic flux, as shown by broken line 38, from permanent magnet 20 passes through outer pole piece 11 through base member 10 and returns through center pole piece 30 across cap 34 into the extremity of tab portion 26 across gap 36 to focusing plate 22. In the second or inner magnetic holding circuit magnetic flux, indicated by broken line 39, from permanent magnet 21 passes through inner pole piece 12 and center pole piece 30 into the inner part of tab portion 26 of the hammer element 14 and across gap 26. The same magnetic flux paths exist for each of the hammer elements. Thus center pole pieces 30 provide a common return path for holding flux from both permanent strip magnets 20 and 21. The strip permanent magnets 20 and 21 can be made relatively thin thereby producing a compact physical and magnetic circuit structure having greatly reduced reluctance and flux leakage. Additionally with the added benefit from focus plate 22, a holding force on the hammer elements 14 at the end hammer positions is appreciably improved compared to a magnetic structure without a focusing plate. Because flux from both magnets 20 and 21 passes in the same direction through a common return path provided by the center pole pieces the selective release of the individual hammer elements is expeditiously performed simply by energizing the desired coils 31 with current applied through connector pins 40 in the direction which produces a counter flux sufficient for reducing the magnetic holding force of both holding circuits on tab portions 26. The common flux return path provides a convenient site for generating the release flux without the need for or concern about reverse polarizing one or both permanent magnets, which are preferably made from very high coercivity materials, and without the need for shunting counter flux to prevent weakening or reverse polarization of the permanent magnets.

Figure 5:
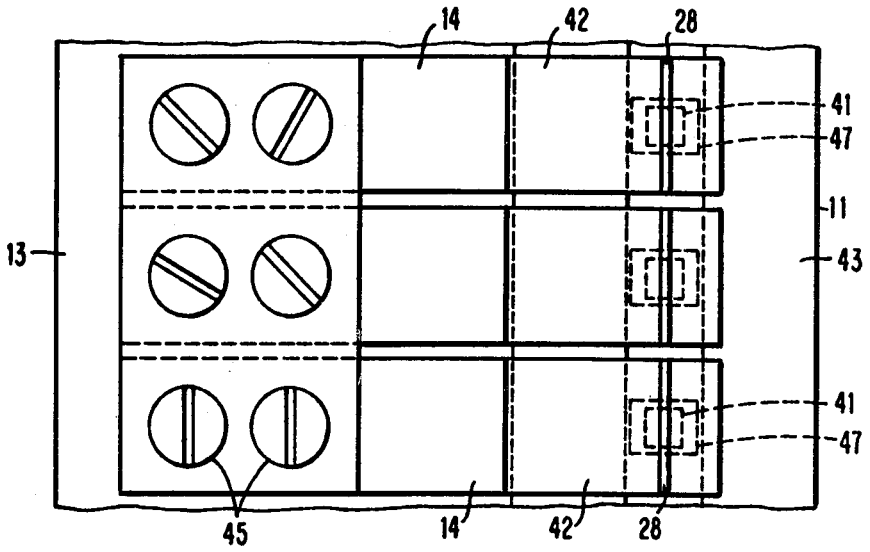
FIG. 5 is a top view of a second embodiment of a print hammer in accordance with the invention.
Figure 6:
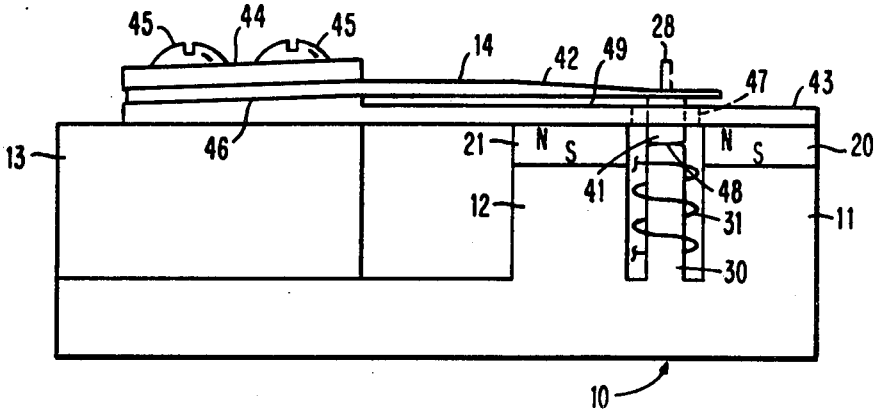
FIG. 6 is a side elevation of the print hammer of FIG. 5.

In the hammer mechanism assembly of FIGS. 5 and 6, the resilient hammer elements 14 may be formed of non-magnetic material. A magnetic armature 41 is attached to the deflection end of elements 14 directly behind the impact blade 28. The deflection end of hammer elements 14 has a section 42 which is tapered to reduce the thickness of the deflection end. Tapering significantly reduces the effective mass of element 14 and compensates somewhat for the increased physical mass of armature 42. A suitable non-magnetic material for the hammer elements can be titanium.

In the embodiment of FIGS. 5 and 6, flux concentration is provided by focusing plate 43 which overlays both permanent magnets 20 and 21 as well as post 13 which is preferably non-magnetic where it is attached with hammer elements 14 by plate 44 and screws 45. The slanted surface 46 on focusing plate 43 cants the hammer elements 14 outwardly when in their unflexed condition. Focusing plate 43 has a rectangular opening 47 aligned with center pole pieces 30. Armatures 41 on the hammer elements 14 extend through the openings 47 to make physical contact with the rounded pole face 48 of center pole pieces 30 which in this case are recessed below the upper surfaces of permanent magnets 20 and 21 so that armatures 41 in their retracted spring loaded as well as in the released position align with the permanent magnets 20 and 21. In retracted condition, armatures 41 make contact with pole face 48 of center pole piece 30 but maintains an air gap 49 between the deflection end of hammer elements 14 and focusing plate 43. This low mass structure allows for quick release when release coil 31 on center pole piece 30 is energized to produce counter flux opposing flux from both permanent magnets 20 and 21 in the common return path. The magnetic mass of armatures 41 is as small as possible, however a low reluctance flux path is provided from permanent magnets 20 and 21 through flux plate 43 and across opening 47 to readily magnetize armatures 41 at or near the saturation level while providing sufficient stored energy in beam 14 for proper actuating characteristics.

Figure 7:
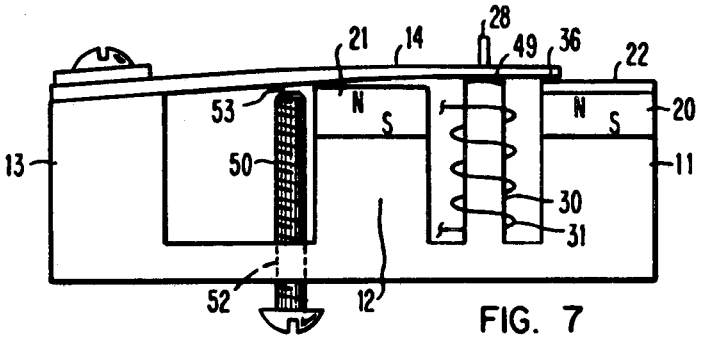
FIG. 7 is a side elevation showing a print hammer actuator with a first embodiment of the adjustable shunt magnetic circuit.
Figure 8:
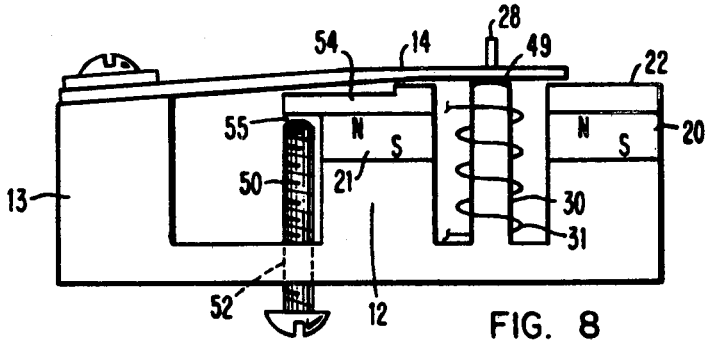
FIG. 8 is a side elevation showing a second embodiment of an adjustable shunt magnetic circuit for a print hammer actuator.
Figure 9:
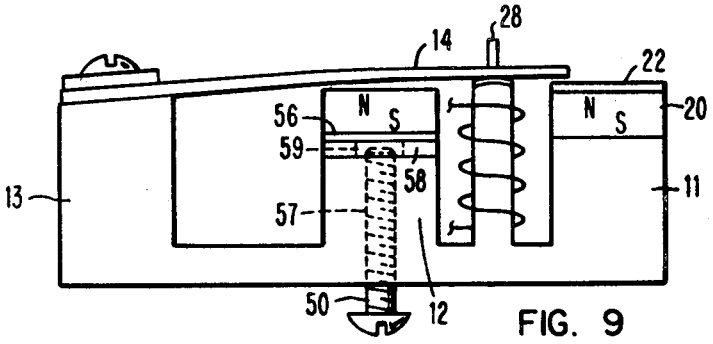
FIG. 9 is a side elevation showing a third embodiment of the adjustable reluctance circuit for a print hammer actuator.

FIGS. 7–9 show other arrangements for obtaining flight time adjustments. In some cases, adjustment at the air gap between the hammer elements and the permanent magnets may not be desirable since this alters, however slightly, the flexure force and flight path length of the spring loaded hammer elements. As seen in the schematized structure of FIG. 7, center pole piece 30 is fixed and its pole face 33 with residual layer 49 extend a fixed distance beyond the surfaces of focusing plate 22 on the outer pole piece 11 and inner permanent magnet 21. In this arrangement a bolt 50 of magnetically permeable material having a threaded connection 52 to base member 10 forms shunt circuit path with inner permanent magnet 21 and inner pole piece 12 for diverting holding magnetic flux from permanent magnet 21 to center pole piece 30. The reluctance of the shunt circuit path is variable by adjustment of the bolt 50 to modify an air gap 53 between the end of magnetic bolt 50 and the magnetic hammer element. The amount of magnetic flux diverted from the inner permanent magnet 21 to bolt 50 is dependent on the dimension of the shunt air gap 53. This in turn adjusts the magnitude of the holding force from inner permanent magnet 21 of the inner holding circuit comprising inner permanent magnet 21, inner pole piece 12, center pole piece 30 and the deflection end of magnetic hammer element 14.

As seen in FIG. 8, the shunt circuit includes a soft iron plate 54 superimposed on the inner permanent magnet 21 whereby a fixed air gap is maintained between the inner holding circuit and the hammer element. Plate 54 overhangs and is aligned with the end of bolt 50. The threaded connection 52 allows bolt 50 to be adjustable for modifying the shunt air gap 55 between the bolt 50 and plate 54. This arrangement also allows adjustment of the reluctance of the inner shunt circuit for diverting magnetic flux from the inner holding circuit thereby reducing the total holding force on the individual hammer elements 14. As seen in FIG. 9, the holding force adjustment is obtained by means which is internal to the inner pole piece 12. A magnetic bolt 50 within threaded opening 57 through magnetic pole piece 12 extends to the end of the pole piece. A magnetically permeable plate 56 is positioned on top of a non-magnetic spacer 58 on the pole piece 12 below permanent magnet 21. Clearance hole 59 through spacer 58 is aligned with bolt 50. Rotation of bolt 50 in threaded opening 57 modifies and adjusts the reluctance of the inner pole piece 12 to thereby alter more or less flux from the center pole piece to modify the holding force on hammer element 14.

In a specific embodiment the hammer mechanism had the following physical parameters:

hammer element 14; beam length from clamping point—1.141 inches beam thickness—0.032 inches; beam width—0.267 inches; tab width—0.118 inches; tab length—0.184 inches; material—8620 steel.

permanent magnets 20 and 21; thickness in the direction of magnetization—0.060 inches; vertical width—0.400 inches; material—samarium cobalt, SmCo5.

coil 31; 345 turns of #34 wire.

The center pole pieces 30 were located 0.860 inches and the impactor blades 28 were located 0.946 inches both from the clamping point. The combined residual on both the beam and center pole pieces 30 was 0.0022 inches thick. The retraction displacement from the neutral position to the residual was 26.8 mils. With residual, the magnetic forces were 0.46 pounds at the neutral position and 1.74 pounds at the retracted position. Without residual, the retraction displacement was 29.0 mils, the magnetic forces were 2.2 pounds at the retracted position and 0.46 pounds at the neutral position and the spring force was 1.48 pounds at the retracted position.

What is claimed is:

1. A hammer mechanism for a device such as a printer comprising a magnetic hammer element comprising an elongated relatively flat beam of resilient material having a relatively small uniform thickness between first and second opposite surfaces and having a fixed end and an opposite deflectable free end and including an impact element extending from said first surface of said beam in the vicinity of said free end, said beam being mounted at the fixed end so as to assume a relatively straight configuration defining a neutral position when not flexed, magnetic circuit means including permanent magnet means and a magnetic core means disposed adjacent said second surface of said beam in the vicinity of said free end thereof so as to be coupled in magnetic circuit with an end portion of said beam immediately adjacent said free end, said magnetic core means includes first, second, and third pole pieces spaced from each other along said end portion of said beam, said third pole piece being located between said first and second pole pieces, said permanent magnet means comprises first and second permanent magnets supported by said first and second pole pieces adjacent said end portion of said beam with said third pole therebetween, said first and second permanent magnets having the same polarity and establishing first and second magnetic fields in the vicinity of said end portion of said beam whereby flux from said first and second permanent magnets flows through said end portion of said beam and returns through said third pole piece, said first and second magnetic fields retracting and holding said beam from said neutral to a retracted position, and means coupled to said third pole piece for counteracting said flux from said first and second permanent magnets in said third pole piece whereby said beam is released for movement from said retracted position toward said neutral position.

2. A hammer mechanism in accordance with claim 1 in which said means for counteracting comprise an electrical winding on said third pole piece, said winding being energizeable to generate flux in said third pole piece in a direction opposing flux from said first and second permanent magnets.

3. A hammer mechanism in accordance with claim 1 in which said third pole piece engages said second surface of said beam when in said retracted position so as to form air gaps between said end portion of said beam and said first and second permanent magnets.

4. A hammer mechanism in accordance with claim 3 in which said third pole piece is movable for adjusting the magnitude of said air gaps between said end portion of said beam and said first and second permanent magnets whereby the retraction force of said first and second magnet fields is controlled.

5. A hammer mechanism in accordance with claim 3 in which said third pole piece engages said second surface of said beam in the vicinity of said end portion when in said retracted position at a point substantially corresponding with the position of the second node of vibration of said beam.

6. A hammer mechanism in accordance with claim 5 in which said impact element extending from said first surface of said beam is located between said position of said second node of vibration and the free end of said beam.

7. A hammer mechanism in accordance with claim 1 in which said end portion of said beam includes a end section magnetizable at least near saturation.

8. A hammer mechanism in accordance with claim 7 in which said end section of said end portion has a reduced width relative to the rest of said beam so as to be magnetizable at least near saturation by flux from said first permanent magnet passing through said beam to said third pole piece.

9. A hammer mechanism in accordance with claim 8 in which said end section includes a rectangular tab section having a width less than the base width of said beam and being magnetizable at least near saturation by said first permanent magnet.

10. A hammer mechanism in accordance with claim 9 in which said tab section extends from said beam beyond said impact element.

11. A hammer mechanism in accordance with claim 10 in which said core means further includes a magnetic plate coupled with said first permanent magnet for concentrating flux across said air gap between said first permanent magnet and said tab section of said beam.

12. A hammer mechanism in accordance with claim 1 in which said core means comprises means for adjusting the magnetic holding force of said permanent magnets on said deflectable free end of said beam.

13. A hammer mechanism in accordance with claim 12 in which said means for adjusting said magnetic holding force comprises means for altering the amount of magnetic flux flowing from said second permanent magnet through said end portion of said beam to said third pole piece.

14. A hammer mechanism in accordance with claim 13 in which said means for altering comprises an adjustable magnetic shunt means connected to said core means and forming a shunt circuit with said second pole piece.

15. A hammer mechanism in accordance with claim 14 in which said shunt means comprises a magnetic member movable for altering the reluctance of said shunt circuit.

16. A hammer mechanism in accordance with claim 15 in which said shunt means comprises a bolt of permeable material having a threaded connection with said core means, said bolt having an end disposed to form a shunt air gap with said end portion of said beam in the vicinity of said second permanent magnet.

17. A hammer mechanism in accordance with claim 16 in which said shunt means further comprises a soft iron pole piece on said second permanent magnet and having a surface forming an air gap with said end portion of said beam, and a shunt element of magnetically permeable material threadedly connected with said core means, said shunt element being disposed to form an air gap with said soft iron pole piece.

18. A hammer mechanism in accordance with claim 12 in which said means for altering the magnetic holding force of said first and second permanent magnets on said end portion of said beam comprises means for adjusting the reluctance of said second pole piece of said core means.

19. A hammer mechanism in accordance with claim 18 in which said means for adjusting the reluctance of said second pole piece comprises spacer means of non-magnetic material on said second pole piece between coupled surfaces of said second pole piece and said second permanent magnet, said spacer means having an aperture therethrough aligned with an an aperture through said second pole piece, a magnetic bolt member coupled with said second pole piece and movable axially within said aperture in said spacer means relative to said second permanent magnet for adjusting the reluctance between said second permanent magnet and said second pole piece.

* * * * *